US012460904B2

(12) United States Patent
Bowman et al.

(10) Patent No.: US 12,460,904 B2
(45) Date of Patent: Nov. 4, 2025

(54) BALLISTIC SOLUTIONS BASED ON PARABOLA CHARACTERISTICS

(71) Applicants: John Bowman, Akron, OH (US); Timothy Barber, Valley City, OH (US)

(72) Inventors: John Bowman, Akron, OH (US); Timothy Barber, Valley City, OH (US)

( * ) Notice: Subject to any disclaimer, the term of this patent is extended or adjusted under 35 U.S.C. 154(b) by 0 days.

(21) Appl. No.: 18/829,067

(22) Filed: Sep. 9, 2024

(65) Prior Publication Data

US 2024/0426577 A1 Dec. 26, 2024

Related U.S. Application Data

(63) Continuation of application No. 18/103,261, filed on Jan. 30, 2023, now Pat. No. 12,085,366.

(51) Int. Cl.
*F41G 3/06* (2006.01)
*F41G 3/16* (2006.01)

(52) U.S. Cl.
CPC ..... *F41G 3/06* (2013.01); *F41G 3/165* (2013.01)

(58) Field of Classification Search
CPC ... F41G 3/06; F41G 3/165; F41G 3/00; F41G 1/38
See application file for complete search history.

(56) References Cited

U.S. PATENT DOCUMENTS 6,069,656 A * 5/2000 Silver ..... G01S 17/89 348/169
2015/0247702 A1* 9/2015 Davidson ..... F41G 1/473 42/122
2024/0384969 A1* 11/2024 Roman ..... F41G 1/38

* cited by examiner

*Primary Examiner* — J. Woodrow Eldred
(74) *Attorney, Agent, or Firm* — Wegman Hessler Valore

(57) ABSTRACT

A target acquisition device that can determine a ballistics solution based on parabola characteristics. The parabola characteristics can be modeled in UI coordinates on the y-axis (e.g., pixels, mm, . . . ) and physical coordinates (e.g., feet, yards, meters, . . . ) on the x-axis. Zeroing data can be leveraged that establishes high quality reference points for two or more zeroed distances such that high quality ballistics solutions can be determined for other suitable (e.g., non-zeroed) distances as a function of parabola modeling techniques.

20 Claims, 8 Drawing Sheets

BALLISTIC SOLUTIONS BASED ON PARABOLA CHARACTERISTICS

CROSS-REFERENCE TO RELATED APPLICATIONS

This application is a continuation of, and claims priority to, U.S. application Ser. No. 18/103,261, filed Jan. 30, 2023, entitled "BALLISTIC SOLUTIONS BASED ON PARABOLA CHARACTERISTICS". The entire contents of this disclosure is hereby incorporated by reference for all purposes, as if fully set forth herein.

TECHNICAL FIELD

The present application relates generally to using distance data and parabola modeling data for ballistics solutions and more particularly to devices or techniques that can determine an aiming point for a target at a distance by leveraging two or more distance reference points.

BACKGROUND

For target acquisition devices, also referred to as sight devices, delivering an accurate ballistics solution is a primary goal. To meet that goal, one fundamental data point that is generally needed is an accurate distance to the target. Hence, many target acquisition devices have an integrated rangefinder device. Once the distance to the target is known, the most common approach to providing a ballistics solution is to plug in various data to a ballistics calculator that typically use a variety of physical constants or laws of nature (e.g., gravity, drag coefficients, . . . ) to determine a trajectory of a given ballistic or projectile.

Using a ballistics calculator can result in accurate ballistics solutions, but other approaches, such as the techniques detailed herein, can deliver accurate ballistic solutions that can be advantageous.

BRIEF DESCRIPTION OF THE DRAWINGS

Numerous aspects, embodiments, objects and advantages of the present invention will be apparent upon consideration of the following detailed description, taken in conjunction with the accompanying drawings, in which like reference characters refer to like parts throughout, and in which.

DETAILED DESCRIPTION

Overview

Figures 1A, 1B, 1C:
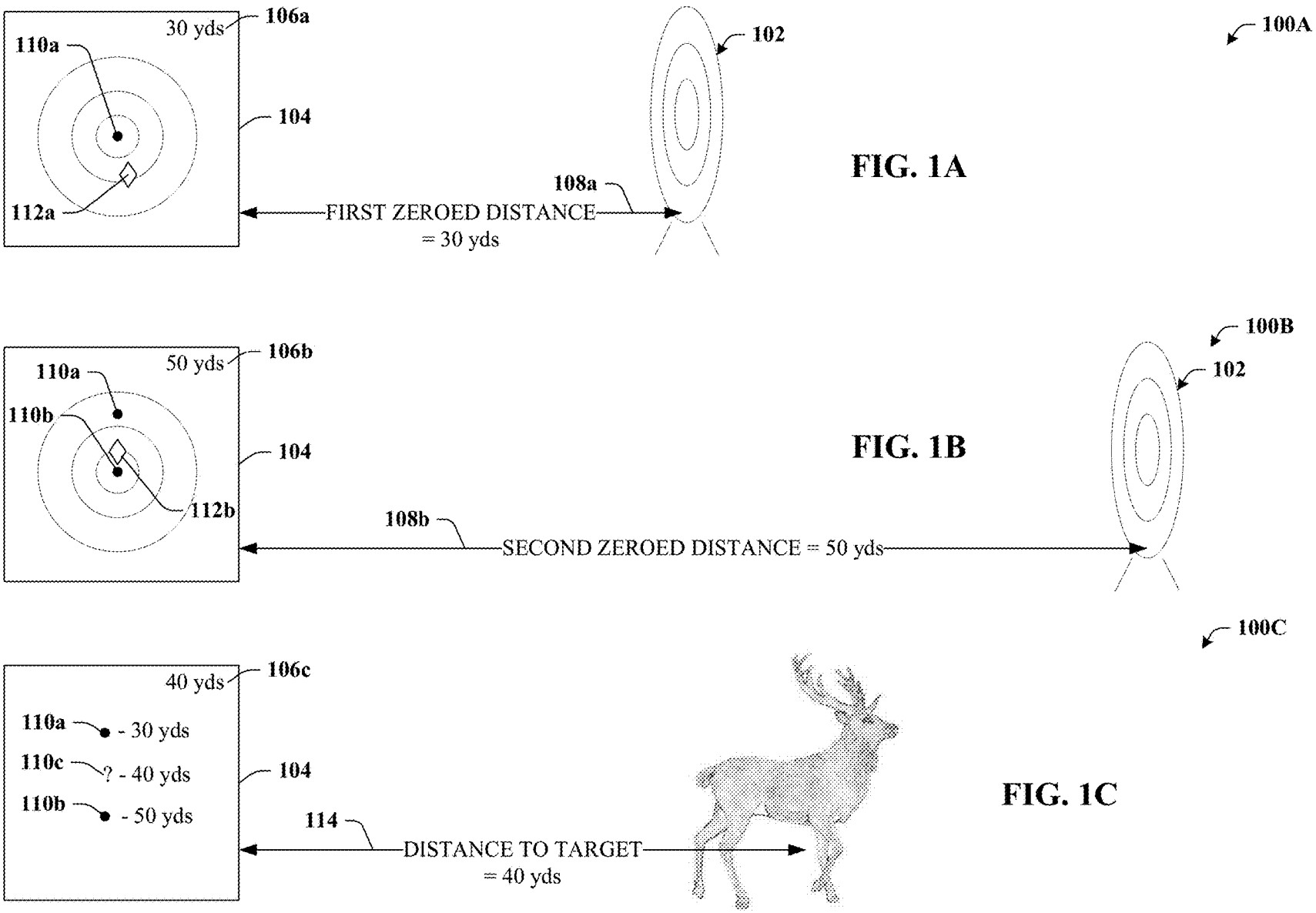
FIG. 1A shows schematic depiction 100A that illustrates a first zeroing procedure in accordance with certain embodiments of this disclosure.
FIG. 1B shows a schematic depiction 100B that illustrates a second zeroing procedure in accordance with certain embodiments of this disclosure.
FIG. 1C shows a schematic depiction 100C of a target that is situated at a distance that differs from those utilized in the first zeroing procedure and the second zeroing procedure in accordance with certain embodiments of this disclosure.

As used herein, the terms "ballistics solution" can mean providing an aiming element at a particular location of a user interface device that accurately corresponds to a point of impact of a projectile at a distance to a target. When providing a ballistics solution, it can be vital that the location of the aiming element accurately indicates the intersection of an arrow, bolt, bullet, or other projectile at the indicated distance. As noted, the most common approach to delivering a ballistics solution is to leverage a ballistics calculator. While the ballistics calculator approach can be very accurate, this approach has significant drawbacks. For example, by using equations derived by Newton or others, ballistics calculators typically require data that simply is not readily available to most people, such as the initial velocity of the projectile or, as a possible alternative, the time of travel of the projectile, various characteristics of the ammunition being discharged, and so forth.

Manufacturers sometimes list some relevant information for their products, but there is no guarantee that the information listed is accurate enough or precise enough even if it is available, or any guarantee that a user's well-worn or old equipment that is being used in extreme conditions will operate identically to the same model or type that was tested by the manufacturer under ideal or simulated conditions.

As a potential alternative, many shooting ranges have special equipment (e.g., chronograph) that can measure initial velocity for a given configuration. Ultimately, while there are suitable ways to obtain the data needed by ballistic calculators, obtaining this information represents a significant drawback for many potential users.

Additionally, ballistic calculators typically require a significant amount of computational resources such as processing, storage, wide area network access, or the like. To meet the demands of a ballistic calculator, an associated target acquisition device may need more computational resources than otherwise, potentially resulting in higher costs, a larger profile or form factor, greater weight, higher energy consumption and/or shorter battery life, or other undesirable consequences.

In order to mitigate these and other potential drawbacks, the disclosed subject matter takes a different approach from that of ballistic calculators in order to provide accurate ballistics solutions. In that regard, data relied upon by the disclosed techniques can be derived at least partially from ordinary zeroing procedures that are familiar to, and readily accessible to, virtually all hunters or other users.

It is observed that substantially any ballistics solution is only as good as the data that is relied upon. It is further observed that data from the actual equipment being used is superior to data from different equipment of the same or similar model or type. Likewise, data obtained under similar conditions (e.g., similar geographical location, weather, or other environmental factors) to what will be observed during live hunting is superior to the same data obtained under dissimilar conditions.

In view of these observations, a case can be made that higher quality data than is typically used by ballistics calculators can be relied upon by the disclosed techniques, resulting in a potentially superior solution based on the quality of the data alone. Furthermore, unlike the ballistics calculator approach, the data can be obtained with very little difficulty and/or in conjunction with a user's ordinary routine.

For instance, a user can perform a zeroing procedure that sets a first aiming element (e.g., adjustable crosshair, mil-dot, reticle, or the like) at a first distance (e.g., 28 yards) and another zeroing procedure that sets the same or a different aiming element at a different distance (e.g., 51 yards) to create two accurate points of reference. In other words, regardless of any characteristic of the projectile equipment (e.g., (1) crossbow, bow, gun, or other projectile device; and (2) arrows, bolts, or other ammunition or projectile) being used, it can be reliably known that the first aiming element is (potentially optimally) accurate for 28 yards and the second aiming element is (potentially optimally) accurate for 51 yards.

More zeroing procedures can be performed at many different distances, which may increase the accuracy or precision of the disclosed techniques, but only two reference points are needed for a high quality ballistics solution at many other distances. Advantageously, this process might only take a few minutes and can be performed with the actual equipment just prior to live hunting, and therefore likely to be under very similar conditions to live hunting.

It is also noted that the zeroing process is not tied to fixed distances that encourage the user to measure and set up exactly some round number from the target. Rather, the user can pace some arbitrary distance from the target, use the integrated or coupled rangefinder to determine the precise distance (e.g., 28.05 yards) to the target, than pace another arbitrary distance (e.g., 51.42 yards) to perform the second zeroing procedure, which can dramatically simplify the zeroing process. Furthermore, if the target acquisition device is equipped with a true distance or true range device, such can be built into the zero process such that it may not even be necessary to shoot at a fixed angle of fire, again, significantly simplifying and expediting the zeroing process.

As will be further detailed herein, a parabola that intersects both of the reference points can be determined, or at least certain characteristics of the parabola can be modeled. From this modeled parabola data, the point of intersection at any other suitable distance can be mapped to screen or user interface coordinates.

Of significant import, the parabola can be constructed to cross over coordinate systems, dramatically simplifying the ballistics solution. For example, the parabola can reflect a user interface (e.g., certain optics or an electronic screen or display) coordinate system in the y-axis, while characterizing physical distance along the x-axis. Hence, data from the rangefinder or any other suitable source can be utilized to surface a third aiming element at the indicated screen coordinates. Thus, based on characteristics of a parabola, an accurate ballistics solution can be generated for substantially any suitable distance to the target.

This solution can be as accurate or in some cases more accurate than a ballistics calculator and this solution mitigates or obviates numerous difficulties associated with ballistic calculators such as, e.g., the difficulty of obtaining reliable data needed for ballistic calculators (e.g., initial velocity or the like, drag coefficients, and so forth), the additional computation or energy resources utilized by ballistic calculators (e.g., parabola modeling techniques detailed herein can utilize an order of magnitude less computational resources), and the strict coordinate systems requirements that must be translated correctly (e.g., translating between the physical environment coordinate system measured in feet, yards, meters or another suitable unit to user interface (UI) coordinate system measured in pixels, millimeters, or another suitable unit.

Conceptually, it is widely understood that the trajectory of a ballistic follows a parabolic path and further that any parabola can be described by the equation: $y=ax^2$. Hence there is some parabola, with some value of a that represents the actual trajectory of the given ballistic. In this context, y can be mapped to a y-axis coordinate of the UI device and/or display device and x can be mapped to x-axis (e.g., zeroed) distance coordinate system in the field of view. In some embodiments, the coefficient, a, can be determined from the two points of reference, that is, from the two zeroed distances in view of the UI device coordinates of corresponding aiming elements for those two zeroed distances. In other embodiments, a ratio between the x and y values can be determined, again, by leveraging the two zeroed distances and associated aiming element locations that represent known, accurate values, or, in other words, known, accurate intersections for a parabola that models the trajectory for the current equipment being used. As one ultimate result, the y-axis coordinate of the display device can be determined for any x-axis distance, such as the x-axis distance to the target subsequently determined by the rangefinder device.

Hence, a first aiming element can be presented at a first y-axis coordinate of the UI that accurately targets the first predetermined, zeroed distance. A second aiming element can be presented at a second y-axis coordinate that accurately targets the second predetermined, zeroed distance. It is observed that these two aiming elements and/or associated y-axis coordinates are known to be potentially optimally accurate for the corresponding two distances because such was established during the zeroing procedures. Additionally or alternatively, the first y-axis coordinate and the second y-axis coordinate can be stored to memory whether or not the first aiming element or the second aiming element are presented to the display device.

Advantageously, based on these two y-axis locations within the coordinate system of the display device that correspond to two predetermined, zeroed distances within the physical world coordinate system, a third aiming element can be presented at a third y-axis coordinate that accurately targets any other suitable distance to a target, such as a distance measurement currently indicated by the rangefinder. In some embodiments, the third y-axis coordinate can be determined as a function of parabola characteristics and a determination of a UI distance between the first y-axis coordinate and the second y-axis coordinate, which is further detailed below.

Example Zeroing Procedures

Various aspects or features of this disclosure are described with reference to the drawings, wherein like reference numerals are used to refer to like elements throughout. In this specification, numerous specific details are set forth in order to provide a thorough understanding of this disclosure. It should be understood, however, that certain aspects of disclosure may be practiced without these specific details, or with other methods, components, materials, etc. In other instances, some structures and devices are shown in block diagram form to facilitate describing the subject disclosure.

FIG. 1A shows schematic depiction 100A that illustrates a first zeroing procedure in accordance with certain embodiments of this disclosure. FIG. 1B shows a schematic depiction 100B that illustrates a second zeroing procedure in accordance with certain embodiments of this disclosure. FIG. 1C shows a schematic depiction 100C of a target that is situated at a distance that differs from those utilized in the first zeroing procedure and the second zeroing procedure in accordance with certain embodiments of this disclosure.

Referring specifically to depiction 100A, practice target 102 is situated some distance from a target acquisition device (TAD) 104. Some modern TADs, such as TAD 104, are communicatively coupled to, or have an integrated rangefinder device. Leveraging this available rangefinder device can simplify a zeroing procedure and serve to capture data used for making subsequent determinations in a simple and convenient manner.

For example, instead of manually measuring a distance to practice target 102, the user can set up any suitable arbitrary distance from practice target 102 and activate the rangefinder device to determine a distance to practice target 102, which in this case is 30 yards. TAD 104 can present this distance on an associated user interface (UI) device, which is illustrated at reference numeral 106*a*. That distance, 30 yards, is also first zeroed distance 108*a* representing the actual or true distance to practice target 102.

For simplicity, round numbers are being used in this example, but it is understood that the precise distance indicated by the rangefinder device, to any suitable number of significant digits (e.g., 29.76 yards), can be used, which represents improved distance data quality over pacing off distances or manually measuring or relying on the accuracy and precision of shooting range equipment or other equipment.

Furthermore, by using the rangefinder device during a zeroing procedure, particularly one with a built-in true distance or true range device, potential errors due to angle of fire can be mitigated, thereby further simplifying and expediting the zeroing process.

Further still, by using the rangefinder device during a zeroing procedure, the relevant data that is used subsequently for ballistic solutions can be captured and stored in a convenient manner, obviating the need for a user to input that data. In other words, the user does not need to manually input that practice target 102 is currently 30 yards because said data can be obtained directly from the rangefinder device during the zeroing procedure.

TAD 104 may also present one or more aiming elements, such as aiming element 110*a*. Typically, the user will place this aiming element 110*a* in the center of the bullseye of practice target 102, as shown, and then discharge the projectile. Hence, aiming element 110*a* represents the intended point of impact (POI), which may differ from the actual POI 112*a*, as illustrated here. Without changing the orientation of an associated projectile device (e.g., crossbow, rifle, . . . ), the user can then provide input to TAD 104 to adjust the location of aiming element 110*a* from the center of practice target 102 to actual POI 112*a* and save that as the new position for aiming element 110*a*.

In this way, with a single zeroing practice shot, first aiming element 110*a* is now located at the correct location on an associated UI device to very accurately correspond to the zeroed distance. In other words, aiming element 110*a* can thereafter be used to intersect any desired POI at 30 yards with extreme accuracy.

The user can then pace any arbitrary other distance from practice target 102 (or alternatively, move the target farther away) and perform a second zeroing procedure. In this example, as shown at depiction 100B, the rangefinder device indicates (e.g., 106*b*) that practice target 102 is now 50 yards away. Hence, 50 yards is the second zeroed distance 108*b*.

TAD 104 can present a second aiming element 110*b* for this greater distance as well as first aiming element 110*a* that was zeroed for 30 yards in the first zeroing procedure. Alternatively, in some embodiments, only one aiming element 110 need be presented and can be used for all zeroing procedures as long as the relevant information (e.g., zeroed distance 108, y-axis UI coordinate, . . . ) at each zeroing procedure is recorded. In this case the actual POI 112*b* is a bit high on practice target 102, but the zeroing adjustment can be made in the same manner as described above.

At this point, certain significant information available to TAD 104 is the UI display coordinate where first aiming element would be presented to hit a target and 30 yards and the UI display coordinate where second aiming element would be presented to hit a target at 50 yards.

As illustrated at depiction 100C, during live hunting or other scenarios, the distance to the target can be any suitable distance, and will almost certainly be a different distance than any of the zeroed distances. In this case, the rangefinder device indicates 40 yards (e.g., 106*c*). Thus, the actual distance 114 to the target is not one of the zeroed distances 108 to which the two visible aiming elements 110*a*, 110*b* correspond.

While first aiming element 110*a* provides an extremely accurate ballistics solution for a target at 30 yards, and second aiming element 110*b* provides an extremely accurate ballistics solution for a target at 50 yards, neither one is accurate for the current target situated at 40 yards. Hence, one challenge is to determine a precise location for a third aiming element 110*c*. In this example, 40 yards was not zeroed, so no UI coordinate was predetermined for that distance. This element is indicated with a "?" because, without further determinations, it is not known where to present aiming element 110*c* for an accurate ballistics solution.

Historically, multi-dot or multi-reticle sights commonly run into this issue, and the solution has, historically, been mostly guesswork, estimation, or rough approximation. In contrast, the disclosed subject matter can determine a very accurate solution (e.g., a precise location for 110*c*), potentially on the same order of accuracy of aiming elements 110*a* and 110*b* representing zeroed distances. Such can be accomplished based on characteristics of parabolas, as further explained below.

Example Parabola Characteristics

Figure 2:
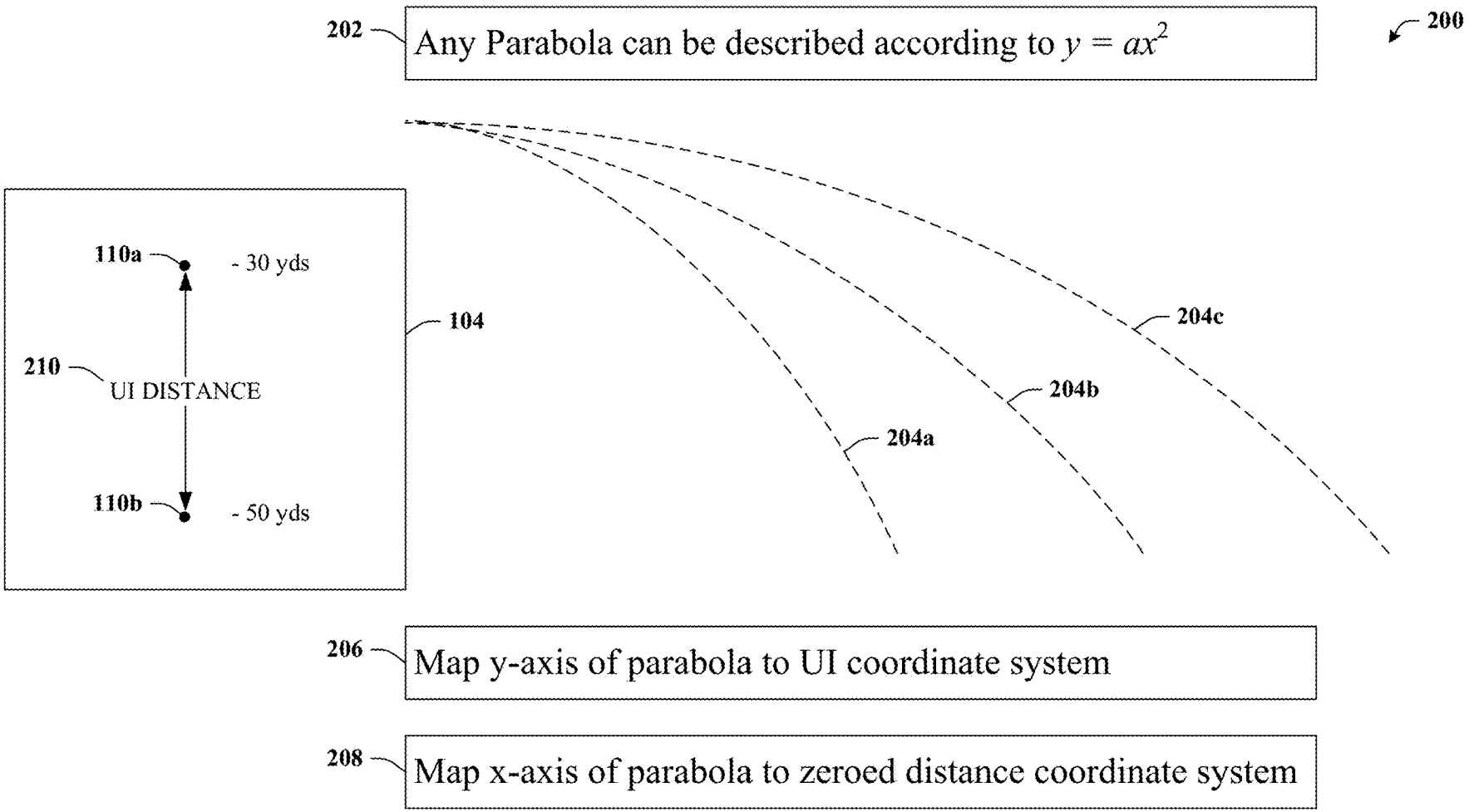
FIG. 2 provides a schematic diagram 200 illustrating certain characteristics of parabolas, particularly in the context of zeroing procedure information and UI coordinate systems in accordance with certain embodiments of this disclosure.

Turning now to FIG. 2, schematic diagram 200 illustrates certain characteristics of parabolas, particularly in the context of zeroing procedure information and UI coordinate systems in accordance with certain embodiments of this disclosure.

Initially, it is observed that the trajectory of a projectile (e.g., arrow, bolt, bullet, or other ballistic) is widely understood to be parabolic due to the nature of gravity. However, when modeling the trajectory of a projectile, parabola definitions are virtually never used. Rather, some form of Newton's gravitational constant or suitable derivations are used, which creates extensive challenges for obtaining high quality data that matches what will be observed for a unique projectile device under substantially unique conditions.

Much of this uncertainty vanishes by performing zeroing procedures, such as those described above, at least because those zeroing procedures are specific to the projectile equipment being used and therefore inherently incorporate all relevant characteristics of the projectile device and associated ammunition.

Regarding parabolas, as indicated at reference numeral 202, any parabola can be described according to $y=ax^2$, where a is referred to herein as a parabola coefficient. Illustrated are three different parabolas, 204*a*, 204*b*, and 204*c*. The primary difference between each of these parabolas is varying values of a, the parabola coefficient. For example, parabola 204*a* may be characterized as $y=2x^2$ (e.g., parabola coefficient=2), while parabola 204*b* may be characterized as $y=x^2$ (e.g., parabola coefficient=1), and parabola 204*c* may be characterized as $y=\frac{1}{2}x^2$ (e.g., parabola coefficient=0.5).

There are an infinite number of potential parabolas 204 and each one has a unique parabola coefficient value that no other parabola shares. Said differently, the value of the parabola coefficient can potentially distinguish the parabola that intersects the zeroed aiming elements at the zeroed distances from all other parabolas. As an observation, the value of a, the parabola coefficient, effectively defines how much rise or drop (e.g., y-axis change) the parabola has per unit of run (e.g., x-axis change). Thus, if it is known how much more the projectile dropped over the second zeroed distance (e.g., 50 yards) than the drop at the first zeroed distance (e.g., 30 yards), the unique parabola that intersects both those points can be determined.

The disclosed subject matter could be used in that way to solve for the parabola coefficient (e.g., the value of a) and thereby identify the unique parabola that intersects targets at both the zeroed distances and thus effectively represents the actual trajectory of the projectile. For example, if it is determined that the projectile drops one foot between 30 yards and 50 yards, then one can readily solve for a.

For example, starting with the understanding that $y=ax^2$, the parabola coefficient is not known, but the values of y and x are known to some degree at two specific points from the two zeroing procedures. That is, $y_1=ax_1^2$ and $y_2=ax_2^2$. Since $x_1$ is known from the first zeroing procedure to be 30 yards and $x_2$ is known from the second zeroing procedure to be 50 yards, then: $y_1=900a$ and $y_2=2500a$. Since we were given that the projectile dropped one foot ($\frac{1}{3}^{rd}$ of a yard) between 30 yards and 50 yards, such can be rewritten as $y_2-y_1=0.3333$ yards. By substitution that means $2500a-900a=0.3333$ yards or $1600a=0.3333$ yards. Now, solving for the parabola coefficient, $a=0.3333/1600=0.0002083125$.

Thus, the parabola defined as $y=(0.0002083125)\cdot x^2$ represents the trajectory of the specific projectile that was fired from the particular weapon being used, and is therefore a reliable indicator of subsequent use of that equipment configuration. The y-axis drop at any x can be readily calculated in order to determine a POI for any distance by using the specific parabola function that was solved above.

However, two difficulties exist with this approach. First, the amount of drop by the projectile is not data that is readily available to ordinary users during a normal zeroing procedure. In other words, this data is not easily obtainable. Second, even if this information is accurately acquired, it still must be converted to UI coordinates in order to render an aiming element at the correct location on the UI device.

To avoid these difficulties, in some embodiments the disclosed techniques can, as illustrated at reference numeral 206, map y-axis values of parabola 204 to the UI coordinate system of TAD 104. Meanwhile, as noted at reference numeral 208, x-axis values of parabola 204 can be mapped to the zeroed distance coordinate system.

As such, it is not necessary to know how much actual distance the projectile dropped between 30 yards and 50 yards. Rather, this information can be substituted with UI distance 210 indicative of a difference (e.g., in millimeters or pixels) between first aiming element 110*a* (or a stored y-axis location value) and second aiming element 110*b* (or a stored y-axis location value). Advantageously, this data is readily available and potentially already captured as part of the zeroing procedures.

Due to the generalized nature of the parabola function, it simply is not necessary to convert or normalize the units. For example, the x-axis units can be yards, while the y-axis units can be pixels, provided that one remains consistent by using the same units for all x-axis calculations and results and likewise using the same units for all y-axis calculations and results. The result of such merely changes the value of the parabola coefficient and removes the need to convert between coordinate systems. Hence, instead of using real-world values of the drop of a projectile, data that is difficult to obtain, one can substitute this with the "drop" between the two aiming elements, referred to herein as UI distance 210, something that is readily obtainable without any extra effort beyond the simplified zeroing procedures detailed herein.

Example Systems

Figure 3:
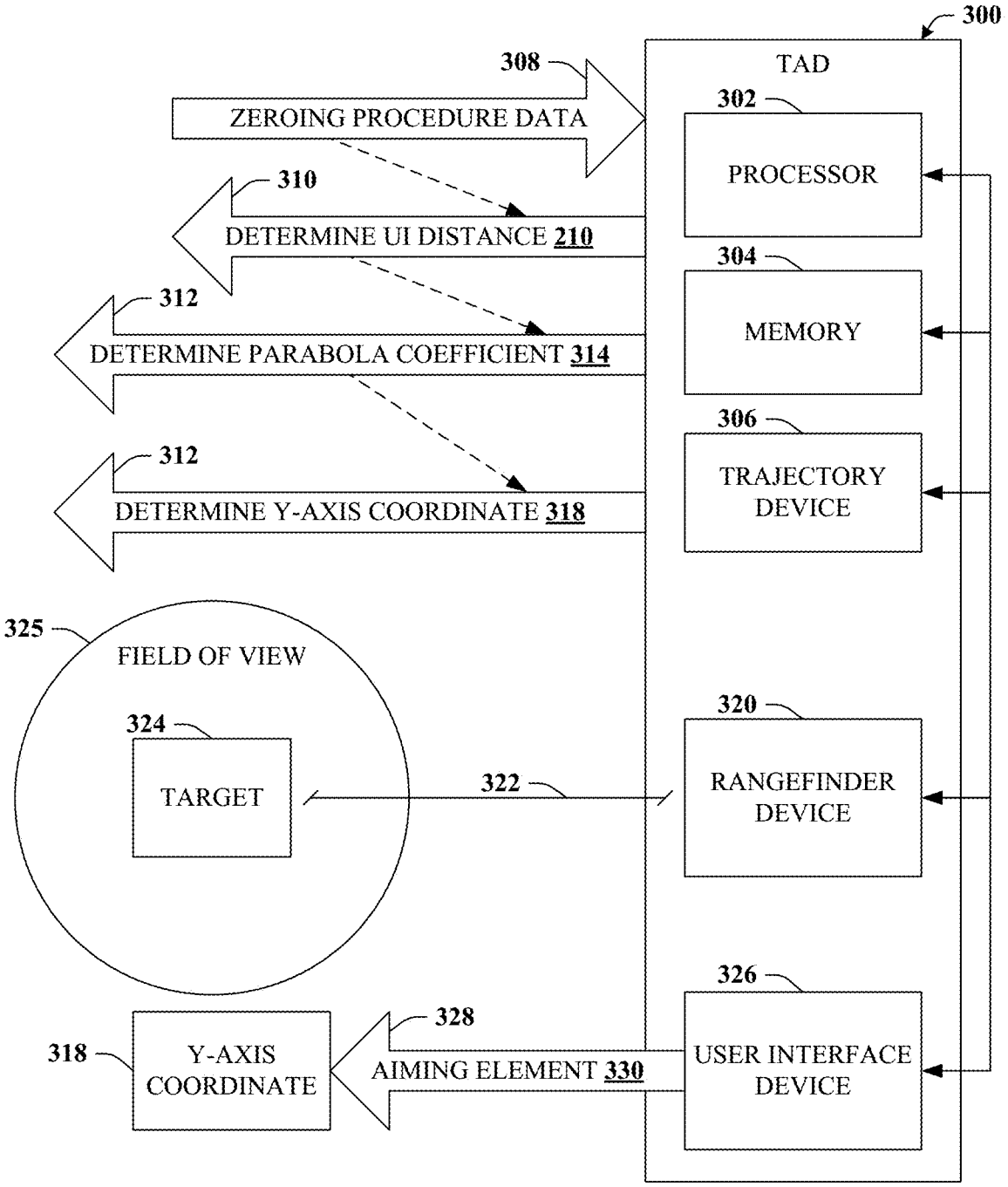
FIG. 3 illustrates a schematic block diagram 300 illustrating a first example target acquisition device (TAD) 300 that can determine a parabola coefficient to provide a ballistics solution in accordance with certain embodiments of this disclosure.

Referring now to FIG. 3, a schematic block diagram 300 is depicted illustrating a first example target acquisition device (TAD) 300 that can determine a parabola coefficient to provide a ballistics solution in accordance with certain embodiments of this disclosure. TAD 300 can comprise a processor 302 that can be specifically configured to determine parabola coefficients and/or provide ballistic solutions based on parabola characteristics. TAD 300 can also comprise memory 304 that stores executable instructions that, when executed by processor 302, can facilitate performance of operations. Processor 302 can be a hardware processor having structural elements known to exist in connection with processing units or circuits, with various operations of processor 302 being represented by functional elements shown in the drawings herein that can require special-purpose instructions, for example, stored in memory 304 and/or trajectory device 306 that can be specially purposed for parabola characteristics and/or trajectory determinations. Along with these special-purpose instructions, processor 302 and/or trajectory device 306 can be a special-purpose device. Further examples of the memory 304 and processor 302 can be found with reference to FIG. 8. It is to be appreciated that TAD 300 or computer 802 can represent a server device or a client device of a communications network and can be used in connection with implementing one or more of the systems, devices, or components shown and described in connection with FIG. 3 or other figures disclosed herein.

In some embodiments, TAD 300 can be mounted to or otherwise associated with a projectile device (e.g., a rifle, handgun, crossbow, vertical bow and so on) that discharges a projectile. TAD 300 can include or can be operatively or communicatively coupled to rangefinder device 320. Rangefinder device 320 can be configured to determine distance 322 to target 324, e.g., in connection with hunting or target shooting, where target 324 can be substantially any object within field of view 325. Distance 322 can be indicated in any suitable units, such as yards, meters, feet, or the like. In some embodiments, rangefinder device 320 can be a precision rangefinder that can be accurate up to 600 yards or more. Range finder device 320 can rely on any suitable technology, non-limiting examples of which can include laser, lidar, radar, sonar, ultrasonic, Doppler techniques and so on.

TAD 300 can further comprise user interface (UI) device 326. UI device 326 can comprise any suitable display device such as an electronic screen or optical viewport. In some embodiments, one or more aiming elements can be presented to UI device 326 to aid in acquiring a target and/or proving a ballistics solution for a target. In some embodiments, two of said aiming elements can be determined from zeroing procedures (e.g., aiming elements 110*a* and 110*b* of FIG. 1), effectively representing fixed distance solutions.

Subsequently, in the event that a ranged target is not at any of the fixed, zeroed distances, another aiming element 330 (e.g., third aiming element 110*c* of FIG. 1) can be presented at the proper UI coordinates (e.g., comprising y-axis coordinate 318) on the UI device to correspond to that particular distance.

To effectuate the above, TAD 300 can receive zeroing procedure data, as indicated at reference numeral 308. Zeroing procedure data can comprise first input data that can be indicative of a first coordinate (e.g., at least a y-axis coordinate) of the UI device that corresponds to a first zeroed distance. For example, the first input data can indicate relevant information obtained during the first zeroing procedure detailed in connection with depiction 100A. In that example, first zeroed distance 108*a* was indicated to be 30 yards and it was established the precise location on UI device 326 at which to present aiming element 110*a*. Hence, first input data can comprise first zeroed distance (e.g., 30 yards in this example) and the first coordinate (e.g., at least a y-axis location of aiming element 110*a* after completion of the first zeroing procedure).

Zeroing procedure data can further comprise second input data that can be indicative of a second coordinate of the UI device 326 that corresponds to a second zeroed distance. Likewise, continuing the example, this second input data can indicate that the post-zeroing procedure location on UI device 326 of second aiming element 110*b* can correspond to 50 yards.

From this zeroing procedure data, UI distance 210 (e.g., the distance and/or y-axis distance between first aiming element 110*a* and second aiming element 110*b*) can be determined. In some embodiments, UI distance 210 can be a physical unit distance such as, e.g., millimeters, inches, centimeters and so on. In some embodiments, UI distance 210 can be determined in screen or display units such as pixels or the like. For instance, UI distance 210 can be indicated as a count of pixels between first aiming element 110*a* and second aiming element 110*b*).

As a concrete example, consider the case where UI distance 210 is 4.7 millimeters (mm). Or, in the case of pixels, suppose UI distance 210 is 81 pixels, which will vary based on the pixels-per-inch (PPI) of a given display device and/or UI device 326.

Recall from above, it was indicated that the drop of the projectile from 30 yards to 50 yards was $1/3^{rd}$ of a yard (e.g., one foot). This one foot drop in the physical world coordinate system essentially corresponds to the "drop" within the coordinate system of UI device, of 4.7 mm or 81 pixels. A difference being which coordinate system one uses for the y-axis. Any coordinate system can be used to generate accurate results, but this disclosure tends to focus in more detail on the UI coordinate system because the requisite data can be of higher quality and can be much simpler and more convenient to obtain, as already illustrated.

At reference numeral 312, TAD 300 can determine parabola coefficient 314 as a function of UI distance 210. That is to say that any y-axis coordinate system can be used, but in this case, the UI coordinate system is being used to determine parabola coefficient 314.

When using the physical world coordinate system (e.g., in yards), recall that the parabola found based on a one-foot drop of the projectile between 30 yards and 50 yards, was described as $y=(0.0002083125)\cdot x^2$. In the same way, the parabola can be determined in the coordinate system for UI device 326 in millimeters or in pixels.

For example, recall that $y_1$=900a (e.g. parabola coefficient 314, a, multiplied by the square of $x_1$, which was 30) and $y_2$=2500a (e.g. parabola coefficient 314, a, multiplied by the square of $x_2$, which was 50). Hence, $y_2-y_1$ again equals 2500a−900a or 1600a.

Thus, in millimeters, UI distance 210 is 4.7 mm=1600a, so, parabola coefficient 314 in millimeters is 0.0029375. On the other hand, in pixels, UI distance 210 is 81 pixels=1600a, so in that case, parabola coefficient 314 is 0.050625.

While the values of parabola coefficient 314 are different in each case, the actual parabola being described could be the same in all cases, if it is assumed that the measurements are correct and/or consistent. The values being used here are merely exemplary and are not intended to align with one another, even though if actual measurements were accurately acquired such would be the case. In other words, the example parabola functions below represent three distinct ways of finding the same unique parabola that models the trajectory of the projectile equipment being used:

$$1:\ y=(0.0002083125)\cdot x^2(y\text{-axis results in yards})$$

$$2:\ y=(0.0029375)\cdot x^2(y\text{-axis results in millimeters})$$

$$3:\ y=(0.050625)\cdot x^2(y\text{-axis results in pixels})$$

Any of the above (or similar) parabola functions used can result in a valid solution, e.g., either (1) where the y-axis change was measured in the physical coordinate system in yards, (2) where the y-axis change was measured in the UI coordinate system in mm, (3) where the y-axis change was measured in the UI coordinate system in pixels, or some other y-axis unit. However, (2) or (3) may be preferred due to the aforementioned quality, convenience, and/or simplicity of data acquisition.

As indicated at reference numeral 312, depending on implementation, TAD 300 can utilize any of these exemplary parabola function (e.g., (1), (2), or (3) cited above) to determine a coordinate on UI device 326 at which to present aiming element 330, e.g., y-axis coordinate 318. Recall, in the example above, while 30 yards and 50 yards were zeroed, the target currently being ranged (e.g., in depiction 100C) is 40 yards away. Hence, aiming element 330 (e.g., third aiming element 110*c* in FIG. 1C) should be presented at the location on UI device 326 indicated by one of the parabola functions.

According to parabola functions (2) and (3), we are already in UI coordinates, so the determined value of y will indicate precisely (along the y-axis) where to place aiming element 330. In the case of parabola function (2), this can be determined as follows. $y_3=ax_3^2$, where $x_3$ is 40. Hence, $y_3=(0.0029375)\cdot 1600$.

However, this value is more meaningful and/or simpler to implement when relative to one the zeroed distances that can be included in zeroing procedure data 308, so the computation can instead rely on a difference from one of the zeroed distances.

That is, $y_3-y_1$ will indicate the distance from first aiming element 110*a*. So, $y_3-y_1=(0.0029375)-(x_3^2-x_1^2)=(0.0029375)\cdot(1600-900)=2.05625$ mm. Thus, since the value is positive, that means y-axis coordinate 318 is below the position of the reference point (e.g., below first aiming element 110*a*). If the value is negative (e.g., if $x_2$ had been used instead of $x_1$), then such would indicate y-axis coordinate 318 is above the position of the reference. Effectively, y-axis coordinate 318 can indicate the location (relative to some zeroed aiming element 110*a*, 110*b*, . . . or location thereof) of where aiming element 330 should be presented. In this example, aiming element 330 is to be presented 2.05625 mm below the location of first aiming element 110*a*.

In this example, $x_1$ is used, but such might also be determined from $x_2$ in other embodiments. To illustrate, $y_3-y_2=(0.0029375)\cdot(x_3^2-x_2^2)=(0.0029375)\cdot(1600-2500)=-2.64375$ mm. Since the value is negative, y-axis coordinate 318 is above the location of second aiming element 110*b*, and in this case 2.64375 mm above. Recall, the UI distance 210 was determined to be 4.7 mm and 2.05625+2.64375=4.7 mm. So, either way results in the same location for y-axis coordinate 318. Thus, as a practice, the zeroed distance that is nearest to the target distance or nearest while still being less than the target distance (e.g., to avoid using negative numbers, if preferred) can be the one selected.

In the case of parabola function (3), such can be determined similarly. For example, $y_3-y_1=(0.050625)\cdot(x_3^2-x_1^2)=(0.050625)\cdot(1600-900)=35.4375$ pixels. Or, alternatively, using second aiming element 110*b* as the reference point, $y_3-y_2=(0.050625)\cdot(x_3^2-x_2^2)=(0.050625)\cdot(1600-2500)=-45.5625$ pixels. Hence, to be accurate at 40 yards, aiming element 330 should be presented about 35 pixels below the location of first aiming element 110*a* and/or the associated UI coordinate captured during the zeroing procedure at 30 yards or about 46 pixels above the location of second aiming element 110*b* and/or the associated UI coordinate captured during the zeroing procedure at 50 yards.

It should be noted that these computations are extremely rapid to generate and extremely low in terms of computing resources used. Thus, very little in terms of processing power or energy are consumed to provide an accurate ballistics solution. That said, there is perhaps in even more streamlined way to determine the same or similar ballistics solution, which is further detailed in connection with FIG. 4.

Figure 4:
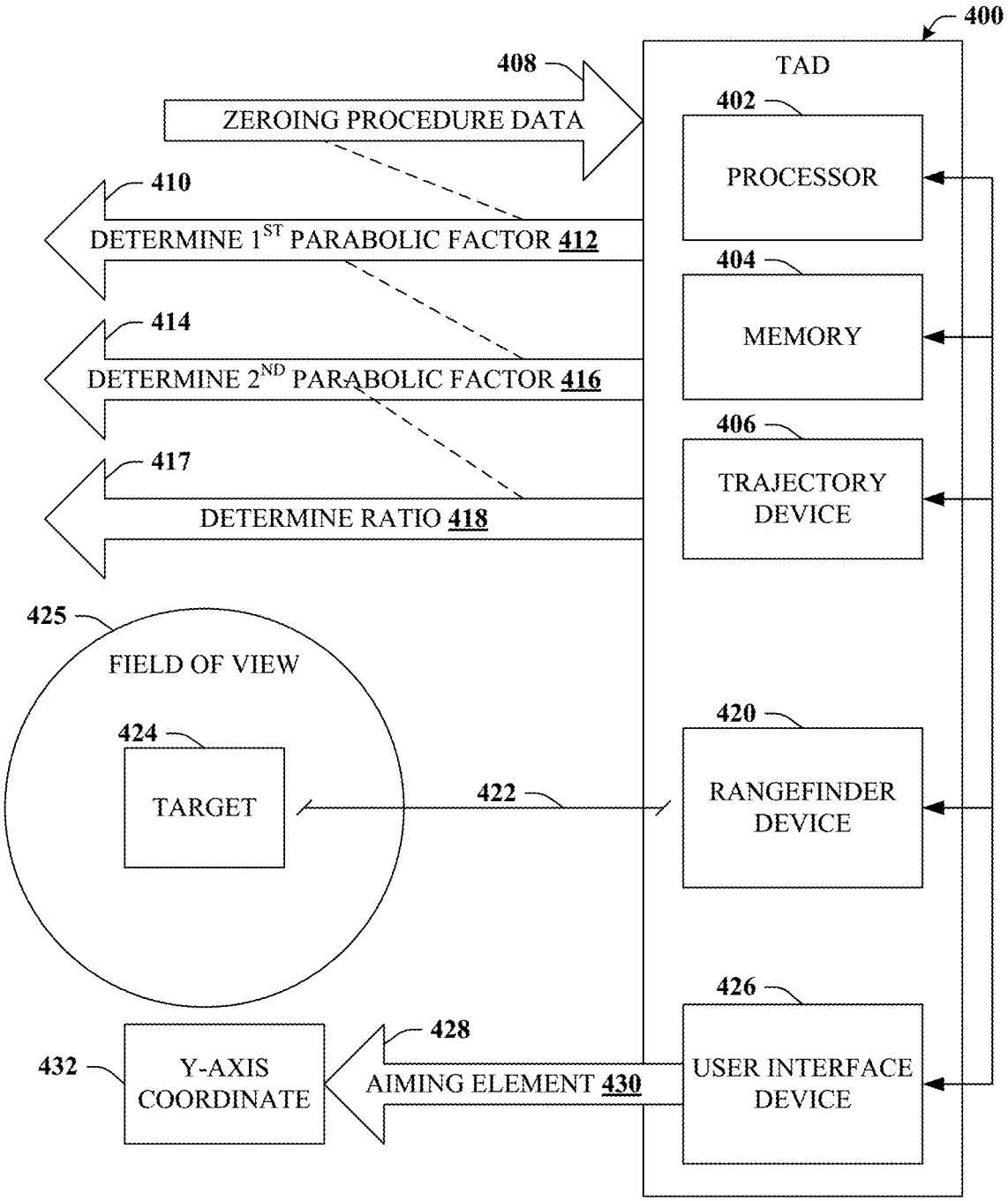
FIG. 4 illustrates a schematic block diagram 400 illustrating a second example target acquisition device (TAD) 400 that can determine a ballistics solution based on a ratio of parabolic factors in accordance with certain embodiments of this disclosure.

Turning now to FIG. 4, a schematic block diagram 400 is depicted illustrating a second example target acquisition device (TAD) 400 that can determine a ballistics solution based on a ratio of parabolic factors in accordance with certain embodiments of this disclosure. TAD 400 can comprise a processor 402 that can be specifically configured to determine parabola characteristics or ratios and/or provide ballistic solutions. TAD 400 can also comprise memory 404 that stores executable instructions that, when executed by processor 402, can facilitate performance of operations. Processor 402 can be a hardware processor having structural elements known to exist in connection with processing units or circuits, with various operations of processor 402 being represented by functional elements shown in the drawings herein that can require special-purpose instructions, for example, stored in memory 404 and/or trajectory device 406. Along with these special-purpose instructions, processor 402 and/or trajectory device 406 can be a special-purpose device. Further examples of the memory 404 and processor 402 can be found with reference to FIG. 8. It is to be appreciated that TAD 400 or computer 802 can represent a server device or a client device of a communications network and can be used in connection with implementing one or more of the systems, devices, or components shown and described in connection with FIG. 4 or other figures disclosed herein. Like elements detailed in connection with FIG. 4 can be substantially similar to As has been thoroughly detailed, a parabola can be modeled as $y=ax^2$. In connection with FIG. 3, a ballistics solution was provided by solving for a, referred to here as parabola coefficient 314. However, the same or similar ballistics solution can be found even without solving for parabola coefficient 314. Rather, the location of y-axis coordinate 432 can be determined as a function of ratio 418. In the context of a ratio, the parabola coefficient cancels out, so it is not strictly necessary to determine parabola coefficient 314.

TAD 400 can comprise or be operatively or communicatively coupled to rangefinder device 420. Rangefinder device 420 can determine a distance 422 to a target 424 that is within a field of view 425 of TAD 400 or component or device thereof. TAD 400 can further comprise UI device 426 that, as illustrated at reference numeral 428, can present aiming element 430 at a coordinate of UI device 426 that is determined to correspond to (e.g., be an accurate ballistics solution for) distance 422. This coordinate can be y-axis coordinate 432. All like element discussed in connection with FIG. 3 can be similar and/or have the same or similar aspects or functions in the context of FIG. 4.

At reference numeral 408, TAD 400 can receive zeroing procedure data, which can be similar as that described in connection with TAD 300 of FIG. 3. For example, zeroing procedure data 408 can include input data indicative of a group (e.g., two or more) of y-axis coordinates of UI device 426. These can include at least a first y-axis coordinate and a second y-axis coordinate that respectively correspond to one of a group of zeroed distances comprising at least a first zeroed distance (e.g., first zeroed distance 108*a*) and a second zeroed distance (e.g., second zeroed distance 108*b*).

At reference numeral 410, TAD 400 can determine first parabolic factor ($pf_1$) 412. First parabolic factor 412 can be determined as a function of a square of at least one member of the group of distances. In some embodiments, first parabolic factor 412 can be determined as follows: $x_2^2-x_1^2$, where $x_1$ and $x_2$ correspond to respective zeroed distances. To keep with the previous example, let $x_1=30$ (e.g., first zeroed distance 108*a*) and $x_2=50$ (e.g., second zeroed distance 108*b*). So, in this example, $pf_1=2500-900=1600$.

At reference numeral 414, TAD 400 can determine second parabolic factor ($pf_2$) 416. Second parabolic factor 416 can be determined as a function of a square of a distance 422 to target 424 that is indicated by rangefinder device 410. In some embodiments, second parabolic factor 416 can be determined as follows: $x_3^2-x_1^2$, where $x_3$ corresponds distance 422 to target 424. To keep with the previous example, let $x_3=40$ (e.g., the ranged distance 422 to target 424). So, in this example, $pf_2=1600-900=700$. It is appreciated that $pf_2$ 416 might also be derived from the second reference point (e.g., $x_2$) without changing the scope of this disclosure, with differences being explained above or otherwise herein.

At reference numeral 417, TAD 400 can determine ratio 418, where ratio 418 can represent a ratio of first parabolic factor 412 and second parabolic factor 416. Hence, ratio 418 can be the quotient of $pf_1/pf_2$. In this example, ratio 418 therefore equals 700/1600=0.4375.

TAD 400 can determine y-axis coordinate 432, that is, the coordinate at which to present aiming element 430 as a function of ratio 418. For example, recall again UI distance 210 in the context of millimeters was determined to be 4.7 mm. 4.7*0.4375=2.05625. Recall also, that 2.05625 was the precise distance from the location of first aiming element 110*a* by which to offset to find y-axis coordinate 318 as detailed in FIG. 3.

Hence, y-axis coordinate 432 provides the same solution in this example, but does so without first determining parabolic coefficient 314. One reason this works out as it does is because, in the context of a parabola function, $y_2-y_1=a(x_2^2-x_1^2)$. Since $pf_1$ is $x_2^2-x_1^2$ in this example, that means $y_2-y_1=a(pf_1)$. Therefore, $y_2-y_1=2500a-900a=1600a$ or $(pf_1)$ a.

Further, $y_3-y_1=a(x_3^2-x_1^2)=a(pf_2)$ or 700*a*. When determining ratio 418, the parabola coefficient 314 cancels out and 700*a*/1600*a* is the same as 700/1600. Hence, there is no need to solve for a, because this technique merely relies on a ratio. The concept draws on the fact that the rise (e.g., y-axis) of a parabola segment will trace in equal proportions to the run (e.g., x-axis) of that parabola segment, noting the quadratic nature on x. Therefore, whatever proportion of the x-axis quadratic one traverses (e.g., 40 yards distance represent 43.75%) will be the same proportion for the y-axis. So, 40 yards distance represents 43.75% of UI distance 210 that indicates the y-axis dimension.

Figure 5:
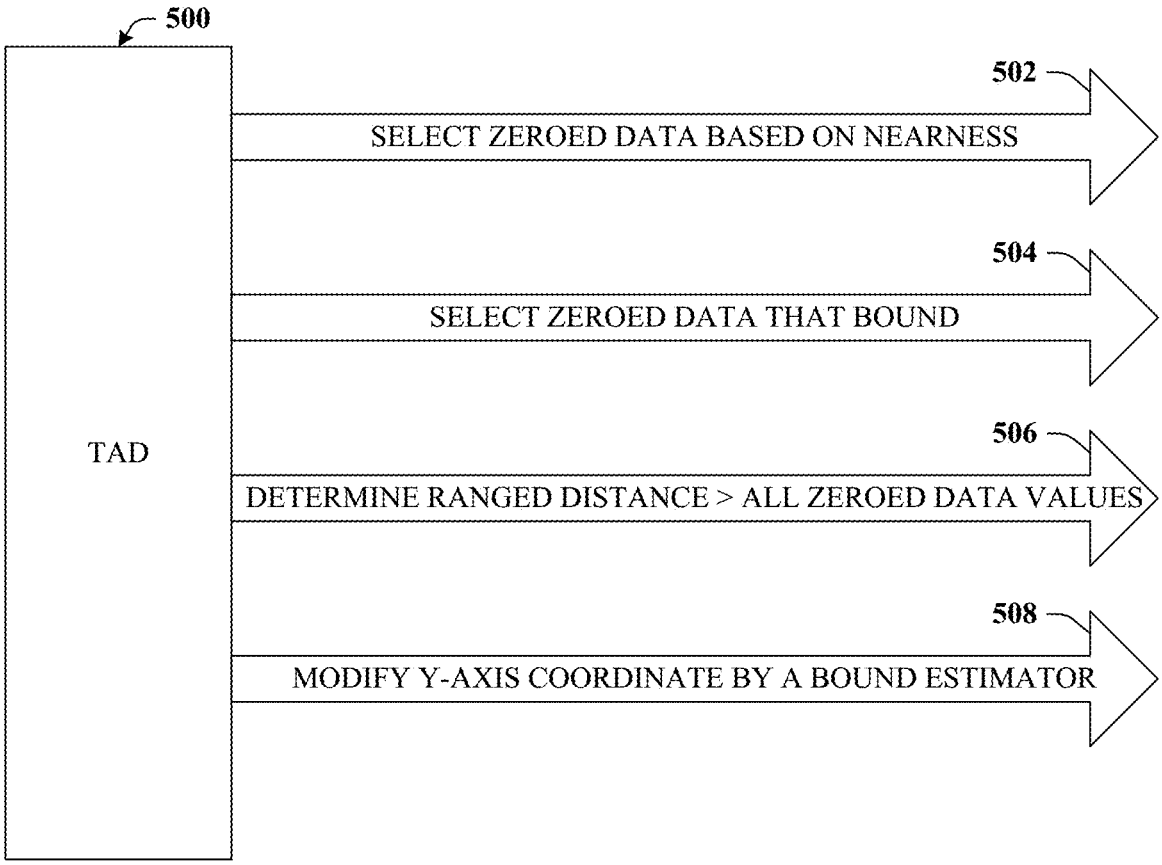
FIG. 5 depicts a schematic block diagram of TAD 500 illustrating additional aspects or elements of providing a ballistics solution based on parabola characteristics in accordance with certain embodiments of this disclosure.

Referring now to FIG. 5, a schematic block diagram of TAD 500 is depicted illustrating additional aspects or elements of providing a ballistics solution based on parabola characteristics in accordance with certain embodiments of this disclosure. TAD 500 can include all or a portion of the elements, aspects, or functions of TAD 300 or TAD 400.

It is observed that to this point it has been generally assumed that the trajectory of a projectile can be described by single parabola. If a projectile is discharged in a vacuum then that would be indeed be the case. However, due to drag, and potentially other natural phenomena, the trajectory is increasingly altered so that, technically, the parabola that defines a trajectory continuously changes.

Thus, in the primary scenario discussed herein, where the two zeroed point are recorded at 30 yards and 50 yards, the parabola discussion was in the context of a single parabola that describes the trajectory for all other distances. In view of the above, it can be observed that these parabola determinations may technically be better described as relating to an average parabola between 30 yards and 50 yards.

As such the disclosed techniques are likely to be more accurate when the actual ranged distance 322, 422 is relatively close to one or more of the zeroed distances 108. Also, when the zeroed distances 108 bound actual ranged distance 322, 422, one can understand that that situation will likely be more accurate than otherwise. That is to say that when one zeroed distance 108*a* is less than ranged distance 322, 422, while the other zeroed distance 108*b* is greater than the ranged distance 322, 422, then the determinations are likely to be more accurate than if such is not the case. This is because the average parabola segment determined from bounding reference points (e.g., 30 yards and 50 yards) is more likely to accurately reflect the ever-changing parabolic trajectory of the projectile within those bounds than when outside those bounds, all other things being equal.

Further, the disclosed techniques are likely to be more accurate as the number of zeroed distances 108 increases. That is, engaging in and recording results for more than two zeroing procedures can be advantageous, although two is generally sufficient, particularly when well-chosen and/or reasonably approximate the distances that are subsequently encountered during live hunting or other use. When more than two zeroed distances 108 are recorded, TAD 500 can leverage the option of intelligently selecting the best two as the reference points.

Based on these observations, one can improve accuracy in a number of ways such as by intelligently selecting the best two reference points. For example, as illustrated at reference numeral 502, in some embodiments TAD 500 can select zeroed data to use as reference points based on nearness. This zeroed data can include the zeroed distance 108 as well as the location of the corresponding zeroing aiming element 110. In that regard, if there are more than two reference points (e.g., zeroed distances 108) to choose from, the two reference points selected can be based on nearness to the actual ranged distance 322, 422.

As illustrated at reference numeral 504, in some embodiments TAD 500 can select zeroed data based on the characteristics that they bound the actual ranged distance 322, 422. For instance, the first reference point can be selected because it relates to a zeroed distance that is less than (and/or the nearest that is less than) the actual ranged distance 322, 422 and the second reference point can be selected because it relates to a zeroed distance that is greater than (and/or the nearest that is greater than) the actual ranged distance 322, 422.

As depicted at reference numeral 506, in some embodiments, TAD 500 determine or identify situations in which actual ranged distance 322, 422 is greater than (or less than) each of the zeroed distances. In other words, it can be determined when no bounding reference points can be selected. In the case where no bounding reference points can be selected, it should be understood that the average parabola between the nearest two reference points that are selected may become increasing less accurate the greater the difference becomes.

For example, if the nearest two reference points correspond to zeroed distances of 30 yards and 50 yards, but the actual ranged distance 322, 422 is 60 yards, it can be imaged that, due to drag effects, the actual trajectory of the projectile will increasing deviate from the average parabola segment modeled between 30 yards and 50 yards. Specifically, the average parabola model will likely predict a trajectory that "longer" or than the actual trajectory. Put another way, the modeled parabola coefficient (e.g., parabola coefficient 314) will likely be larger than that for the actual trajectory history that is increasingly altered by drag or wind.

By recognizing this, in case where there is no zeroed data that bound, TAD 500 can in some embodiments, modify y-axis coordinate 318, 432 by a boundary estimator, which is illustrated at reference numeral 508. This boundary estimator can potentially mitigate certain inaccuracies that result. This boundary estimator can attempt to intelligently correct for the aforementioned issues, such as effectively decreasing parabola coefficient 314 (or modifying ratio 418 in a like manner) when the ranged distance 322, 422 is greater than all zeroed distances 108, or effectively increasing parabola coefficient 314 when the ranged distance 322, 422 is less than all zeroed distances 322, 422.

Extensive tests were performed in this regard. It was discovered that when the two reference points bound the actual distance, such as the primary example scenario in which zeroed distances 108 selected are 30 yards and 50 yards respectively and the actual ranged distance 322, 422 is 40 yards (or another value that is greater than 30 yards and less than 50 yards), then the determined y-axis coordinate 318, 432 was extremely accurate, in some cases wholly accurate to the precision limits of the testing equipment.

When the actual ranged distance 322, 422 went outside these bounds, small inaccuracies sometimes occurred and were in fact expected. For example, at 60 yards, which represents a 20% increase beyond the greatest zeroed distance of 50 yards, the y-axis coordinate 318, 432 was found in one case to be off (e.g., too high on UI device 326, 426) by about 0.3 mm or 4%. At 70 yards, this error increased in one case to 8% or about 0.6 mm.

It is not verified that this estimation error is linear, but in any case, the boundary estimator can be used to offset such error in any suitable manner. For example, effectively lowering y-axis coordinate 318, 432 by a useful percentage (e.g., of UI distance 210) when greater than the bounds of the selected zeroed distances 108 or raising y-axis coordinate 318, 432 by the same or different percentage when less than the bounds of the selected zeroed distances 108. In some embodiments, the boundary estimator can reflect a percentage of UI distance 210 by which to modify y-axis coordinate 318, 432. In some embodiments, the boundary estimator can reflect a percentage of a selected zeroed distance 108, or a difference between a selected zeroed distance 108 and the ranged distance 322, 422.

Example Methods

Figure 6:
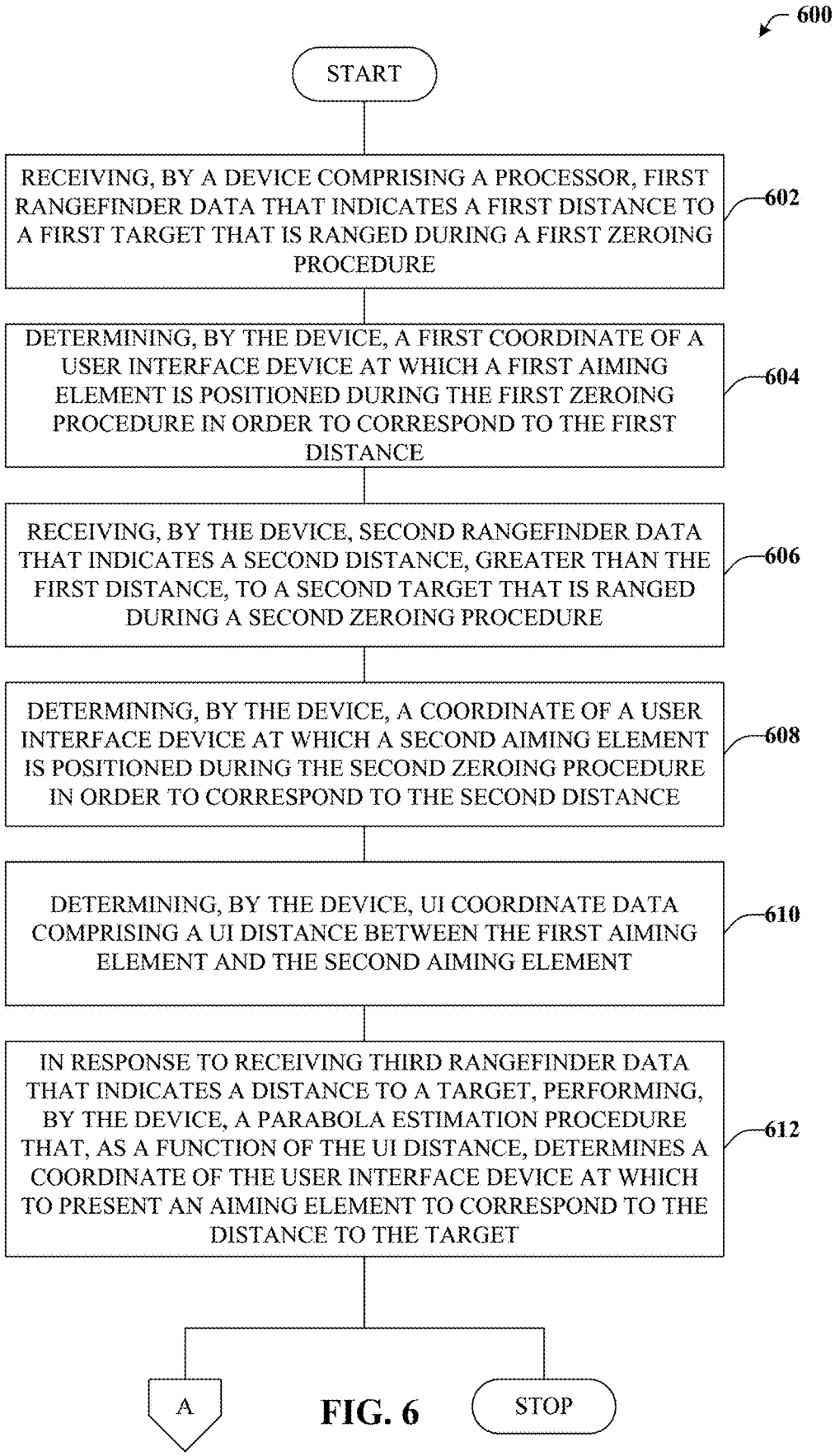
FIG. 6 depicts an example method 600 that can determine a ballistics solution based on parabola characteristics in accordance with certain embodiments of this disclosure.
Figure 7:
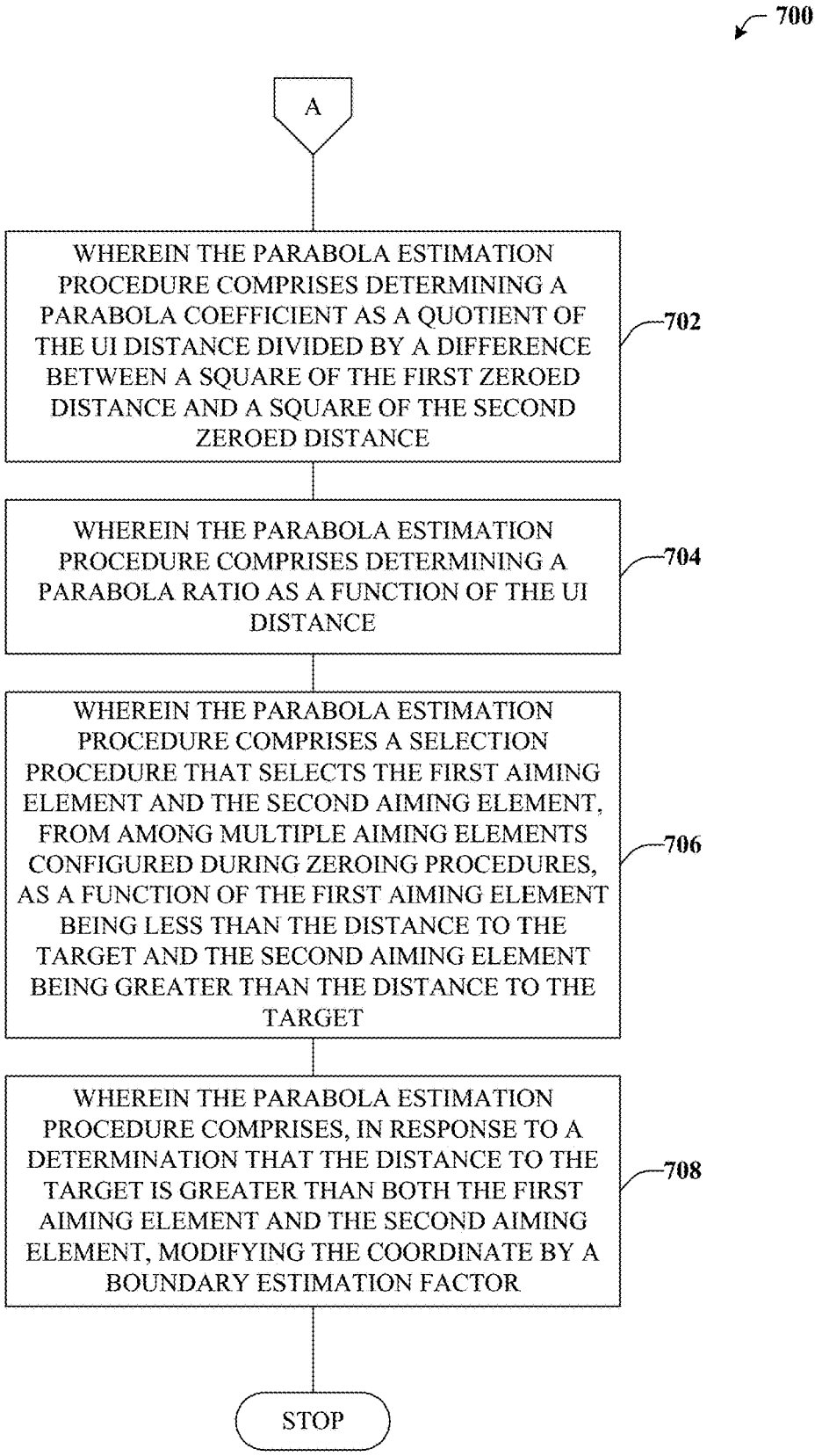
FIG. 7 illustrates an example method 700 that can provide for additional aspect or elements in connection with the parabola modeling procedure in accordance with certain embodiments of this disclosure.

FIGS. 6 and 7 illustrate various methods in accordance with the disclosed subject matter. While, for purposes of simplicity of explanation, the methods are shown and described as a series of acts, it is to be understood and appreciated that the disclosed subject matter is not limited by the order of acts, as some acts may occur in different orders and/or concurrently with other acts from that shown and described herein. For example, those skilled in the art will understand and appreciate that a method could alternatively be represented as a series of interrelated states or events, such as in a state diagram. Moreover, not all illustrated acts may be required to implement a method in accordance with the disclosed subject matter. Additionally, it should be further appreciated that the methods disclosed hereinafter and throughout this specification are capable of being stored on an article of manufacture to facilitate transporting and transferring such methods to computers.

Referring now to FIG. 6, exemplary method 600 is depicted. Method 600 can determine a ballistics solution based on parabola characteristics in accordance with certain embodiments of this disclosure. While method 600 describes a complete method, in some embodiments, method 600 can include one or more elements of method 700, as illustrated by insert A.

At reference numeral 602, a device comprising a processor can receive first rangefinder data that indicates a first distance to a first target that is ranged during a first zeroing procedure. In other words, the rangefinder device can be used during zeroing procedures to establish high quality data. At reference numeral 604, the device can determine a first coordinate of a user interface device at which a first aiming element is positioned during the first zeroing procedure in order to correspond to the first distance. That is, once the aiming element is repositioned to correspond to the actual POI during the zeroing procedure, the coordinate of that aiming element represents a superior ballistics solution for the first (zeroed) distance.

These processes can be repeated for additional data points. For example, at reference numeral 606, the device can receive second rangefinder data that indicates a second distance, greater than the first distance, to a second target that is ranged during a second zeroing procedure. At reference numeral 608, the device can determine a second coordinate of a user interface device at which a second aiming element is positioned during the second zeroing procedure in order to correspond to the second distance. Again, once the second aiming element is repositioned to correspond to the actual POI during the second zeroing procedure, the coordinate of the second aiming element represents a superior ballistics solution for the second (zeroed) distance.

At reference numeral 610, the device can determine UI coordinate data comprising a UI distance. UI distance can be indicative of a distance between the first aiming element and the second aiming element. This distance can be any units that are pertinent to a UI coordinate system such as pixels, mm, or the like.

At reference numeral 612, the device can present a third aiming element that is determined to correspond to a subsequently ranged distance. For example, in response to receiving third rangefinder data that indicates a distance to a target, the device, can perform a parabola modeling procedure. This parabola modeling procedure can determines a coordinate of the user interface device at which to present an aiming element to correspond to the distance to the target as a function of the UI distance. Method 600 can terminate or continue to insert A, which is further detailed in connection with FIG. 7.

Turning now to FIG. 7, exemplary method 700 is depicted. Method 700 can provide for additional aspect or elements in connection with the parabola modeling procedure in accordance with certain embodiments of this disclosure.

At reference numeral 702, the device introduced at reference numeral 602 comprising a processor that can determine a parabola coefficient. The parabola coefficient can be determined as a quotient of the UI distance divided by a difference between a square of the first zeroed distance and a square of the second zeroed distance.

At reference numeral 704, the parabola modeling procedure can comprise determining a parabola ratio as a function of the UI distance. At reference numeral 706, the parabola modeling procedure can comprise a selection procedure. The selection procedure can select the first aiming element and the second aiming element, from among multiple aiming elements configured during zeroing procedures. Thus, if more than two zeroing procedures are performed, the selection procedure can select two and do so such that the selected zeroed aiming elements are selected based on a bounding condition. That is, for example, as a function of the first aiming element being less than the distance to the target and the second aiming element being greater than the distance to the target.

At reference numeral 706, the parabola modeling procedure can detect when bounding aiming elements are not possible and apply a boundary factor in response. For example, in response to a determination that the distance to the target is greater than both the first aiming element and the second aiming element, modifying the coordinate by a boundary factor.

Example Operating Environments

Figure 8:
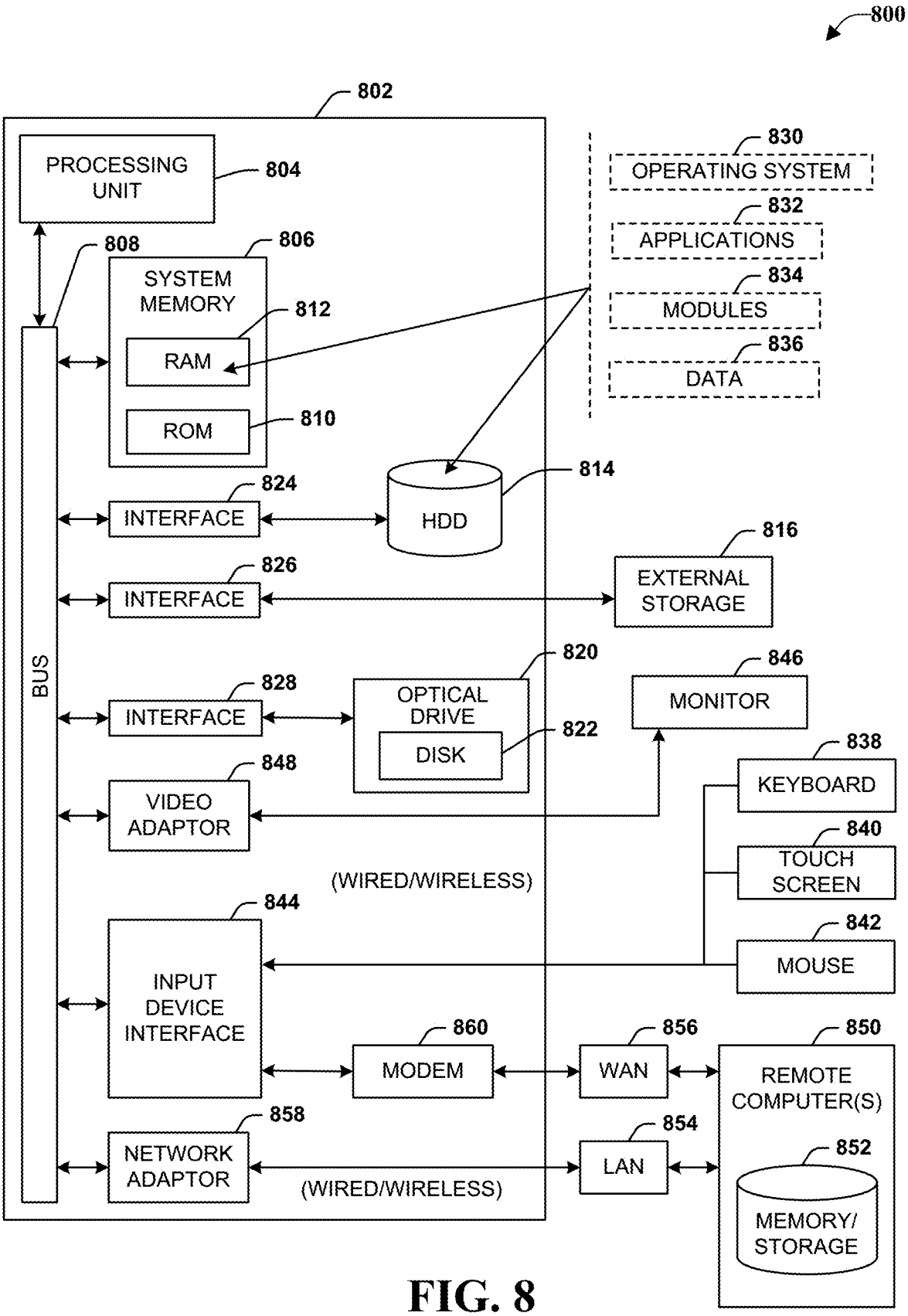
FIG. 8 illustrates an example schematic block diagram of a computer operable to execute certain embodiments of this disclosure.

Referring now to FIG. 8, there is illustrated a schematic block diagram of an exemplary computer system operable to execute the disclosed architecture. In order to provide additional context for various embodiments described herein, FIG. 8 and the following discussion are intended to provide a brief, general description of a suitable computing environment 800 in which the various embodiments of the embodiment described herein can be implemented. While the embodiments have been described above in the general context of computer-executable instructions that can run on one or more computers, those skilled in the art will recognize that the embodiments can be also implemented in combination with other program modules and/or as a combination of hardware and software.

Generally, program modules include routines, programs, components, data structures, etc., that perform particular tasks or implement particular abstract data types. Moreover, those skilled in the art will appreciate that the various methods can be practiced with other computer system configurations, including single-processor or multiprocessor computer systems, minicomputers, mainframe computers, Internet-of-Things (IoT) devices, distributed computing systems, as well as personal computers, hand-held computing devices, microprocessor-based or programmable consumer electronics, and the like, each of which can be operatively coupled to one or more associated devices.

The illustrated embodiments of the embodiments herein can be also practiced in distributed computing environments where certain tasks are performed by remote processing devices that are linked through a communications network. In a distributed computing environment, program modules can be located in both local and remote memory storage devices.

Computing devices typically include a variety of media, which can include computer-readable storage media, machine-readable storage media, and/or communications media, which two terms are used herein differently from one another as follows. Computer-readable storage media or machine-readable storage media can be any available storage media that can be accessed by the computer and includes both volatile and nonvolatile media, removable and non-removable media. By way of example, and not limitation, computer-readable storage media or machine-readable storage media can be implemented in connection with any method or technology for storage of information such as computer-readable or machine-readable instructions, program modules, structured data or unstructured data.

Computer-readable storage media can include, but are not limited to, random access memory (RAM), read only memory (ROM), electrically erasable programmable read only memory (EEPROM), flash memory or other memory technology, compact disk read only memory (CD-ROM), digital versatile disk (DVD), Blu-ray disc (BD) or other optical disk storage, magnetic cassettes, magnetic tape, magnetic disk storage or other magnetic storage devices, solid state drives or other solid state storage devices, or other tangible and/or non-transitory media which can be used to store desired information. In this regard, the terms "tangible" or "non-transitory" herein as applied to storage, memory or computer-readable media, are to be understood to exclude only propagating transitory signals per se as modifiers and do not relinquish rights to all standard storage, memory or computer-readable media that are not only propagating transitory signals per se.

Computer-readable storage media can be accessed by one or more local or remote computing devices, e.g., via access requests, queries or other data retrieval protocols, for a variety of operations with respect to the information stored by the medium.

Communications media typically embody computer-readable instructions, data structures, program modules or other structured or unstructured data in a data signal such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

With reference again to FIG. 8, the example environment 800 for implementing various embodiments of the aspects described herein includes a computer 802, the computer 802 including a processing unit 804, a system memory 806 and a system bus 808. The system bus 808 couples system components including, but not limited to, the system memory 806 to the processing unit 804. The processing unit 804 can be any of various commercially available processors. Dual microprocessors and other multi-processor architectures can also be employed as the processing unit 804.

The system bus 808 can be any of several types of bus structure that can further interconnect to a memory bus (with or without a memory controller), a peripheral bus, and a local bus using any of a variety of commercially available bus architectures. The system memory 806 includes ROM 810 and RAM 812. A basic input/output system (BIOS) can be stored in a non-volatile memory such as ROM, erasable programmable read only memory (EPROM), EEPROM, which BIOS contains the basic routines that help to transfer information between elements within the computer 802, such as during startup. The RAM 812 can also include a high-speed RAM such as static RAM for caching data.

The computer 802 further includes an internal hard disk drive (HDD) 814 (e.g., EIDE, SATA), one or more external storage devices 816 (e.g., a magnetic floppy disk drive (FDD) 816, a memory stick or flash drive reader, a memory card reader, etc.) and an optical disk drive 820 (e.g., which can read or write from a CD-ROM disc, a DVD, a BD, etc.). While the internal HDD 814 is illustrated as located within the computer 802, the internal HDD 814 can also be configured for external use in a suitable chassis (not shown). Additionally, while not shown in environment 800, a solid state drive (SSD) could be used in addition to, or in place of, an HDD 814. The HDD 814, external storage device(s) 816 and optical disk drive 820 can be connected to the system bus 808 by an HDD interface 824, an external storage interface 826 and an optical drive interface 828, respectively. The interface 824 for external drive implementations can include at least one or both of Universal Serial Bus (USB) and Institute of Electrical and Electronics Engineers (IEEE) 894 interface technologies. Other external drive connection technologies are within contemplation of the embodiments described herein.

The drives and their associated computer-readable storage media provide nonvolatile storage of data, data structures, computer-executable instructions, and so forth. For the computer 802, the drives and storage media accommodate the storage of any data in a suitable digital format. Although the description of computer-readable storage media above refers to respective types of storage devices, it should be appreciated by those skilled in the art that other types of storage media which are readable by a computer, whether presently existing or developed in the future, could also be used in the example operating environment, and further, that any such storage media can contain computer-executable instructions for performing the methods described herein.

A number of program modules can be stored in the drives and RAM 812, including an operating system 830, one or more application programs 832, other program modules 834 and program data 836. All or portions of the operating system, applications, modules, and/or data can also be cached in the RAM 812. The systems and methods described herein can be implemented utilizing various commercially available operating systems or combinations of operating systems.

Computer 802 can optionally comprise emulation technologies. For example, a hypervisor (not shown) or other intermediary can emulate a hardware environment for operating system 830, and the emulated hardware can optionally be different from the hardware illustrated in FIG. 8. In such an embodiment, operating system 830 can comprise one virtual machine (VM) of multiple VMs hosted at computer 802. Furthermore, operating system 830 can provide runtime environments, such as the Java runtime environment or the NET framework, for applications 832. Runtime environments are consistent execution environments that allow applications 832 to run on any operating system that includes the runtime environment. Similarly, operating system 830 can support containers, and applications 832 can be in the form of containers, which are lightweight, standalone, executable packages of software that include, e.g., code, runtime, system tools, system libraries and settings for an application.

Further, computer 802 can be enable with a security module, such as a trusted processing module (TPM). For instance, with a TPM, boot components hash next in time boot components, and wait for a match of results to secured values, before loading a next boot component. This process can take place at any layer in the code execution stack of computer 802, e.g., applied at the application execution level or at the operating system (OS) kernel level, thereby enabling security at any level of code execution.

A user can enter commands and information into the computer 802 through one or more wired/wireless input devices, e.g., a keyboard 838, a touch screen 840, and a pointing device, such as a mouse 842. Other input devices (not shown) can include a microphone, an infrared (IR) remote control, a radio frequency (RF) remote control, or other remote control, a joystick, a virtual reality controller and/or virtual reality headset, a game pad, a stylus pen, an image input device, e.g., camera(s), a gesture sensor input device, a vision movement sensor input device, an emotion or facial detection device, a biometric input device, e.g., fingerprint or iris scanner, or the like. These and other input devices are often connected to the processing unit 804 through an input device interface 844 that can be coupled to the system bus 808, but can be connected by other interfaces, such as a parallel port, an IEEE1394 serial port, a game port, a USB port, an IR interface, a BLUETOOTH® interface, etc.

A monitor 846 or other type of display device can be also connected to the system bus 808 via an interface, such as a video adapter 848. In addition to the monitor 846, a computer typically includes other peripheral output devices (not shown), such as speakers, printers, etc.

The computer 802 can operate in a networked environment using logical connections via wired and/or wireless communications to one or more remote computers, such as a remote computer(s) 850. The remote computer(s) 850 can be a workstation, a server computer, a router, a personal computer, portable computer, microprocessor-based entertainment appliance, a peer device or other common network node, and typically includes many or all of the elements described relative to the computer 802, although, for purposes of brevity, only a memory/storage device 852 is illustrated. The logical connections depicted include wired/wireless connectivity to a local area network (LAN) 854 and/or larger networks, e.g., a wide area network (WAN) 856. Such LAN and WAN networking environments are commonplace in offices and companies, and facilitate enterprise-wide computer networks, such as intranets, all of which can connect to a global communications network, e.g., the Internet.

When used in a LAN networking environment, the computer 802 can be connected to the local network 854 through a wired and/or wireless communication network interface or adapter 858. The adapter 858 can facilitate wired or wireless communication to the LAN 854, which can also include a wireless access point (AP) disposed thereon for communicating with the adapter 858 in a wireless mode.

When used in a WAN networking environment, the computer 802 can include a modem 860 or can be connected to a communications server on the WAN 856 via other means for establishing communications over the WAN 856, such as by way of the Internet. The modem 860, which can be internal or external and a wired or wireless device, can be connected to the system bus 808 via the input device interface 844. In a networked environment, program modules depicted relative to the computer 802 or portions thereof, can be stored in the remote memory/storage device 852. It will be appreciated that the network connections shown are example and other means of establishing a communications link between the computers can be used.

The computer 802 is operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This comprises at least Wi-Fi and Bluetooth™ wireless technologies. Thus, the communication can be a predefined structure as with a conventional network or simply an ad hoc communication between at least two devices.

Wi-Fi, or Wireless Fidelity, allows connection to the Internet from a couch at home, a bed in a hotel room, or a conference room at work, without wires. Wi-Fi is a wireless technology similar to that used in a cell phone that enables such devices, e.g., computers, to send and receive data indoors and out; anywhere within the range of a base station. Wi-Fi networks use radio technologies called IEEE 802.11 (a, b, g, n, etc.) to provide secure, reliable, fast wireless connectivity. A Wi-Fi network can be used to connect computers to each other, to the Internet, and to wired networks (which use IEEE 802.3 or Ethernet). Wi-Fi networks operate in the unlicensed 2.4 and 5 GHz radio bands, at an 11 Mbps (802.11b) or 54 Mbps (802.11a) data rate, for example, or with products that contain both bands (dual band), so the networks can provide real-world performance similar to the basic "10BaseT" wired Ethernet networks used in many offices.

What has been described above comprises examples of the various embodiments. It is, of course, not possible to describe every conceivable combination of components or methodologies for purposes of describing the embodiments, but one of ordinary skill in the art may recognize that many further combinations and permutations are possible. Accordingly, the detailed description is intended to embrace all such alterations, modifications, and variations that fall within the spirit and scope of the appended claims.

As used in this application, the terms "system," "component," "interface," and the like are generally intended to refer to a computer-related entity or an entity related to an operational machine with one or more specific functionalities. The entities disclosed herein can be either hardware, a combination of hardware and software, software, or software in execution. For example, a component may be, but is not limited to being, a process running on a processor, a processor, an object, an executable, a thread of execution, a program, and/or a computer. By way of illustration, both an application running on a server and the server can be a component. One or more components may reside within a process and/or thread of execution and a component may be localized on one computer and/or distributed between two or more computers. These components also can execute from various computer readable storage media having various data structures stored thereon. The components may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry that is operated by software or firmware application(s) executed by a processor, wherein the processor can be internal or external to the apparatus and executes at least a part of the software or firmware application. As yet another example, a component can be an apparatus that provides specific functionality through electronic components without mechanical parts, the electronic components can comprise a processor therein to execute software or firmware that confers at least in part the functionality of the electronic components. An interface can comprise input/output (I/O) components as well as associated processor, application, and/or API components.

Furthermore, the disclosed subject matter may be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from by a computing device.

As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit nano-scale architectures such as, but not limited to, molecular and quantum-dot based transistors, switches and gates, in order to optimize space usage or enhance performance of user equipment. A processor also can be implemented as a combination of computing processing units.

In the subject specification, terms such as "store," "data store," "data storage," "database," "repository," "queue", and substantially any other information storage component relevant to operation and functionality of a component, refer to "memory components," or entities embodied in a "memory" or components comprising the memory. It will be appreciated that the memory components described herein can be either volatile memory or nonvolatile memory, or can comprise both volatile and nonvolatile memory. In addition, memory components or memory elements can be removable or stationary. Moreover, memory can be internal or external to a device or component, or removable or stationary. Memory can comprise various types of media that are readable by a computer, such as hard-disc drives, zip drives, magnetic cassettes, flash memory cards or other types of memory cards, cartridges, or the like.

By way of illustration, and not limitation, nonvolatile memory can comprise read only memory (ROM), programmable ROM (PROM), electrically programmable ROM (EPROM), electrically erasable ROM (EEPROM), or flash memory. Volatile memory can comprise random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

In particular and in regard to the various functions performed by the above described components, devices, circuits, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the embodiments. In this regard, it will also be recognized that the embodiments comprise a system as well as a computer-readable medium having computer-executable instructions for performing the acts and/or events of the various methods.

Computing devices typically comprise a variety of media, which can comprise computer-readable storage media and/or communications media, which two terms are used herein differently from one another as follows. Computer-readable storage media can be any available storage media that can be accessed by the computer and comprises both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can comprise, but are not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

On the other hand, communications media typically embody computer-readable instructions, data structures, program modules or other structured or unstructured data in a data signal such as a modulated data signal, e.g., a carrier wave or other transport mechanism, and comprises any information delivery or transport media. The term "modulated data signal" or signals refers to a signal that has one or more of its characteristics set or changed in such a manner as to encode information in one or more signals. By way of example, and not limitation, communications media comprise wired media, such as a wired network or direct-wired connection, and wireless media such as acoustic, RF, infrared and other wireless media Moreover, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. As used in this application, the term "or" is intended to mean an inclusive "or" rather than an exclusive "or" and can thus be read as "and/or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be specifically directed to a singular form.

In addition, while a particular feature may have been disclosed with respect to only one of several implementations, such feature may be combined with one or more other features of the other implementations as may be desired and advantageous for any given or particular application. Furthermore, to the extent that the terms "includes" and "including" and variants thereof are used in either the detailed description or the claims, these terms are intended to be inclusive in a manner similar to the term "comprising."

What is claimed is:

1. A target acquisition device, comprising:

a processor; and a memory that stores executable instructions that, when executed by the processor, facilitate performance of operations, the operations comprising:

receiving first input data indicative of a first screen coordinate of a user interface (UI) device, wherein the first screen coordinate represents a first ballistic solution for a target at a first distance;

receiving second input data indicative of a second screen coordinate of the UI device, wherein the second screen coordinate represents a second ballistic solution for the target at a second distance that differs from the first distance;

receiving third input data indicative of a third distance to the target that differs from the first distance and the second distance;

as a function of a UI distance between the first screen coordinate and the second screen coordinate, determining a parabola coefficient; and as a function of the parabola coefficient, determining a third screen coordinate indicative of a third ballistic solution at the third distance.

2. The target acquisition device of claim 1, wherein the UI distance is a physical distance along a vertical axis between the first screen coordinate and the second screen coordinate.

3. The target acquisition device of claim 1, wherein the UI distance is a count of pixels along a vertical axis between the first screen coordinate and the second screen coordinate.

4. The target acquisition device of claim 1, wherein the parabola coefficient is determined as a quotient of a first term divided by a second term, wherein the first term is the UI distance and the second term is a difference between a square of the first distance and a square of the second distance.

5. The target acquisition device of claim 1, wherein the third screen coordinate is determined as a product of the parabola coefficient and a square of the third distance.

6. The target acquisition device of claim 1, wherein the operations further comprise receiving aggregate input data comprising the first input data that corresponds to the first distance, the second input data that corresponds to the second distance, and a group of additional data comprising at least fourth input data indicative of a fourth screen coordinate of the UI device indicative of a fourth ballistic solution for the target at a fourth distance that differs from the first distance and the second distance.

7. The target acquisition device of claim 6, wherein the operations further comprise selecting, from among a group of distance values that correspond to the aggregate input data, two target distances that are determined to be nearest to the third distance to the target.

8. The target acquisition device of claim 7, wherein the operations further comprise setting the first screen coordinate to a first value that corresponds to one of the two target distances and the second screen coordinate to a second value that corresponds to another of the two target distances, resulting in a determination of the UI distance as a distance between two screen coordinates that correspond to the two target distances that are nearest to the third distance.

9. The target acquisition device of claim 6, wherein the operations further comprise selecting, from among a group of target distance values that correspond to the aggregate input data, two target distances comprising one distance that is determined to be less than the third distance to the target and another target distance that is determined to be greater than the third distance to the target.

10. The target acquisition device of claim 1, wherein, in response to a determination that the third distance to the target is greater than both the first distance and the second distance, determining the third screen coordinate as the function of the parabola coefficient and further as a function of a drag estimator that is determined as a function of a difference between the third distance and at least one of the first distance or the second distance.

11. A target acquisition device, comprising:

a processor; and a memory that stores executable instructions that, when executed by the processor, facilitate performance of operations, the operations comprising:

receiving input data indicative of a group of screen coordinates of a user interface (UI) device, comprising a first screen coordinate and a second screen coordinate, that respectively indicate a ballistic solution for one of a group of distances to a target, comprising a first distance to a target and a second distance to the target;

as a function of a square of at least one member of the group of distances, determining a first parabolic factor;

in response to receiving range data indicative of a third distance to the target, determining a second parabolic factor as a function of a square of the third distance; and as a function of a ratio of the first parabolic factor and the second parabolic factor, determining a third screen coordinate indicative of a ballistic solution for the third distance.

12. The target acquisition device of claim 11, wherein the first parabolic factor is determined as a difference between a square of the second zeroed distance and a square of the first zeroed distance.

13. The target acquisition device of claim 11, wherein the second parabolic factor is determined as a difference between a square of the third distance and a square of the first distance.

14. The target acquisition device of claim 11, wherein the ratio is a quotient of the second parabolic factor divided by the first parabolic factor.

15. The target acquisition device of claim 11, wherein the operations further comprise determining a UI distance between the first screen coordinate of the UI device and the second screen coordinate of the UI device.

16. The target acquisition device of claim 15, wherein the third screen coordinate is determined as a percentage of the UI distance that results from a product of the UI distance and the ratio.

17. A method, comprising:

determining, by a device comprising a processor, a first screen coordinate of a user interface (UI) device indicative of a first ballistic solution for a first distance to a target;

determining, by the device, a second screen coordinate of the UI device indicative of a second ballistic solution for a second distance, different than the first distance, to the target;

determining, by the device, UI coordinate data comprising a UI distance between the first aiming element and the second aiming element; and in response to receiving range data that indicates a third distance to the target, performing, by the device, a parabola estimation procedure that, as a function of the UI distance, determines a third screen coordinate of the UI device indicative of a third ballistic solution for the third distance to the target.

18. The method of claim 17, wherein the parabola estimation procedure comprises determining a parabola coefficient as a quotient of the UI distance divided by a difference between a square of the first distance and a square of the second distance.

19. The method of claim 17, wherein the parabola estimation procedure comprises determining a parabola ratio as a function of the UI distance.

20. The method of claim 17, wherein the parabola estimation procedure comprises, in response to a determination that the distance to the target is greater than both the first aiming element and the second aiming element, modifying the coordinate by a drag estimation factor.

* * * * *